United States Patent [19]

Takazawa et al.

[11] Patent Number: 4,774,105

[45] Date of Patent: Sep. 27, 1988

[54] HEAVY DUTY ANTICORROSION TREATMENT OF METAL ARTICLES

[75] Inventors: Hisayoshi Takazawa; Ryoji Takekoshi; Yuzo Matsudaira; Yoshio Nakakoshi; Senkichi Nakakoshi, all of Tokyo, Japan

[73] Assignees: Terry Kogyo Kabushiki Kaisha; Nippon Telegraph and Telephone Corporation, both of Tokyo, Japan

[21] Appl. No.: 140,906

[22] Filed: Dec. 30, 1987

Related U.S. Application Data

[63] Continuation of Ser. No. 911,668, Sep. 25, 1986, abandoned.

[30] Foreign Application Priority Data

Sep. 26, 1985 [JP] Japan ..... 60-211124

[51] Int. Cl.[4] ..... B05D 1/24

[52] U.S. Cl. ..... 427/185; 427/378; 427/195; 427/388.1

[58] Field of Search ..... 427/185, 195, 388.1, 427/, 404, 374.4

[56] References Cited

U.S. PATENT DOCUMENTS

| | | | |
|---|---|---|---|
| 3,834,933 | 9/1974 | Voogel | 427/405 |
| 4,407,893 | 10/1983 | Malizio | 427/374.4 |
| 4,531,947 | 7/1985 | Engelhardt | 427/195 |
| 4,612,216 | 9/1986 | Kurfman | 427/404 |

*Primary Examiner*—Thurman K. Page
*Assistant Examiner*—L. R. Horne
*Attorney, Agent, or Firm*—Hill, Van Santen, Steadman & Simpson

[57] ABSTRACT

A process for heavy-duty anticorrosion treatment of a metal article is provided wherein the article, promptly after being hot plated, is coated with a synthetic resin thereby to bake the resin on the plated article with the heat remaining in the plated article.

8 Claims, 1 Drawing Sheet

HEAVY DUTY ANTICORROSION TREATMENT OF METAL ARTICLES

This is a continuation of application Ser. No. 911,668 filed Sept. 25, 1986, now abandoned.

BACKGROUND OF THE INVENTION

1. Field of the Invention

This invention relates to a heavy-duty anticorrosion treatment of metal articles to be used in heavily corrosive environments.

2. Description of the Prior Art

Hitherto, metal articles to be used in heavily corrosive environments have been subjected to a heavy-duty anticorrosion treatment. More specifically, a metal article to be protected from corrosion is subjected to pretreatment and then soaked in a plating bath containing a molten metal, such as zinc, to provide a coating of the metal on the surface of the article. It has been previously believed that the metal article thus treated should be cooled rapidly in a flow of water to prevent growth of a low-strength alloy layer which is formed at the interfacial boundary between the article and the metal coating. After such plating treatment, the plated article is heated for subsequent treatment, baked with a synthetic resin to provide a coating of the resin on the plated article, and then cooled with water to accomplish heavy-duty anticorrosion treatment.

The metal article thus treated has defects in that a fragile metallic layer grows at the boundary between the plated layer and the metal article and that surface oxidation on the plated layer occurs due to heating for the baking treatment, which result in deterioration in mechanical properties of the plated layer and also in deterioration in adhesion between the plated layer and the baked synthetic resin layer. Moreover, such conventional method requires additional heating apparatus for re-heating treatment before the baking.

Thus, an object of the present invention is to provide a process for heavy-duty anticorrosion treatment of metal articles to give anticorrosive metal articles having an excellent durability when used in a heavily corrosive environment.

Another object of the invention is to provide the above mentioned process which can be carried out efficiently with low cost.

Other objects and advantages of the invention will be apparent from the description given below.

SUMMARY OF THE INVENTION

The present inventors have found that heat remaining in the metal article freshly plated with a molten metal can be utilized for the subsequent baking treatment, instead of rapidly cooling the hot plated article with water and re-heating the plated article; whereby adhesion between a plated layer and a baked synthetic resin layer is markedly increased and durability of the resulting article is remarkably enhanced. It is indeed unexpectable that such effects are obtained by utilizing the heat left in the plated articles because it has been considered to be essential to rapidly cool the freshly plated metal article to avoid growth of an alloy layer between the metal article and the plated layer.

Thus, a process for heavy-duty anticorrosion treatment of a metal article, according to the present invention, comprises plating a metal article with a molten metal and then applying a synthetic resin material onto the resulting hot plated article to bake the synthetic resin on the plated article with the heat remaining in the plated article. As necessary, the hot plated article is allowed to cool in air to a suitable baking temperature before applying the resin material.

DETAILED DESCRIPTION OF THE INVENTION

Figure 1:
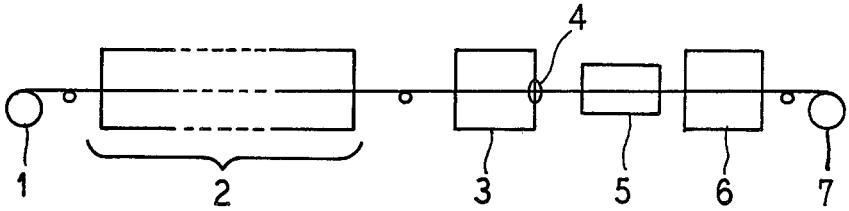
FIG. 1 is a flow sheet of an embodiment of the heavy-duty anticorrosion treatment of a steel wire according to the present invention.

The metal articles to betreated according to the invention can be in any shape, and preferably in the form of continuous articles, such as wire, rod,sheet, etc. The articles are generally made of metals which are readily corroded in a corrosive environment, such as iron, steel, copper, and alloys thereof, and particularly steel.

The metal to be used forplating includes zinc, tin, aluminum, zinc-aluminum alloys, etc., and is preferably zinc and a zinc-aluminum alloy. The thickness of the plated layer (i.e. metal coating) is usually in the range of from about 20 to 100 microns.

As the coating syntheticresin, one can use any synthetic resin that is usable for heavy-duty corrosion protection coating, such as saturated or unsaturated polyesters, epoxy resins, nylons, polyethylenes, vinyl chlorides, etc. Among them, saturated polyester is preferably used. Such synthetic resins are used in the form of a powder, a film or a solid paint, and normally in the form of powder. The baking temperature of such synthetic resin varies depending upon the kind of the resin used, but is usually in the range of about 150° to 450° C. For example, the typical baking temperature of a saturated polyester and nylon is approximately from 350° to 400° C., that of a epoxy resin and unsaturated polyester is approximately 250° C., and that of polyethylene and vinyl chloride is approximately 200° C. The thickness of the synthetic resin layer is usually in the range of about 50 to 2000 microns.

The process of the invention can be conducted continuously or successively.

Because the process of the invention does not require a heating procedure before a baking treatment as is needed in the conventional method, it is possible to prevent both growth of a fragile alloy layer between a metal article and a plated layer thereon and also surface oxidation of the plated layer, both of which result from long time heating of the plated article especially when the metal article has a large volume with a large heat capacity. Thus, the mechanical strength of the final article can be increased and a synthetic resin coating can be adhered firmly to the plated layer. Moreoever, cost of anticorrosion treatment can be largely reduced since a heating apparatus is not especially needed. Also, workability of the process will be markedly increased because rapid cooling after plating and heating before baking as in the conventional process are not needed.

The present invention is further explained in detail by way of the following examples.

EXAMPLE 1

This example illustrates a heavy-duty anticorrosion treatment wherein a steel article is protected with a zinc coating and a saturated polyester coating.

A steel article is subjected to a molten zinc plating treatment according to a conventional process. Then the article is taken up from the zinc bath and allowed to cool in air until the surface of the plated article is cooled to a temperature in the range of approximately 350° to 400° C. The article thus plated is then soaked in a fluidized soaking vessel containing Terry Powder (trade name, powdery saturated polyester manufactured by Terry Kogyo Co., Ltd., Japan) for about 2 to 10 seconds to provide a baked coating of the saturated polyester on the plated surface of the article. Immediately thereafter, the resulting article is soaked in a water vessel to rapidly cool it, taken out therefrom, and then dried to accomplish heavy-duty anticorrosion treatment.

The time required from taking up the article from the zinc bath to the termination of the final water cooling is generally about 1 to 2 minutes. Thus, baking of saturated polyester is accomplished in an extremely short period of time; the time required for baking treatment is reduced to approximately one tenth compared with a conventional baking treatment wherein baking is conducted after re-heating a plated article.

The adhesion between the zinc layer and the saturated polyester layer of the articles treated according to the present process is markedly superior to that of articles treated according to a conventional method. Thus, adhesion evaluation was made on samples of steel plates (50×100×30 mm) having a zinc layer of about 75 microns thick and a saturated polyester layer of 250 microns thick by providing on the surface of each sample crosscuts of 1 mm×1 mm with such depth as to reach the plated layer and subjecting such samples to bending tests with a bending angle of 90°. Peeling of the polyester layer was observed in the sample prepared according to the conventional method, whereas no peeling thereof was observed at all in the sample prepared according to the present invention. The polyester layer of the sample according to the invention was not peeled off even when forced to peel by using an edge of a cutter knife.

EXAMPLE 2

This example illustrates a continuous heavy-duty anticorrosion treatment of a steel wire wherein the wire is subjected to plating with molten zinc and then baking with saturated polyester powder.

FIG. 1 schematically illustrates one process of this example. In the drawing, 1 is a steel wire drum, 2 is a pretreatment apparatus for zinc plating, 3 is a zinc bath, 4 is a squeezing means, 5 is a fluidized soaking vessel charged with Terry Powder (a saturated polyester powder as described above), 6 is a water vessel used for water cooling, and 7 is a drum for winding up a steel wire which has been finished with anticorrosion treatment. Zinc plating is carried out as in conventional method by passing a steel wire from the steel wire drum 1 through the pre-treatment apparatus 2 and then the zinc bath 3. After taking up from the zinc bath 3 and then passsing through the squeezing means 4, the steel wire is passed through the fluidized soaking vessel 5 located with such a distance from the zinc bath 3 that the surface of the plated layer on the steel wire can be air-cooled to about 350° to 400° C. when it reaches the vessel 5, to bake the saturated polyester powder on the plated layer of the wire while it passes therethrough. The steel wire thus treated is then passed through the water vessel 6 for water cooling and thereafter is wound up on the drum 7. Baking treatment can be conducted by blowing saturated polyester powder onto the surface of the plated steel wire by means of an air gun and the like instead of passing through the fluidized soaking vessel 5.

According to the process of the present invention, excellent adhesion between a plated layer and a baked resin layer can be obtained as in Example 1. Thus, the articles treated in accordance with the present process are provided with sufficient corrosion resistance even when they are used in a heavy corrosive environment.

Furthermore, since the process of the invention utilizes for baking treatment heat provided from molten metal plating, conventional water cooling after plating and heating before baking treatment are eliminated, and thereby the time required for anticorrosion treatment is markedly reduced. Moreover, a heating apparatus is not needed, which largely reduces equipment costs. In addition, workability or efficiency of the process can be further increased because molten metal plating and baking of synthetic resin can be carried out successively.

We claim:

1. A process for heavy-duty anticorrosion treatment of a metal article which comprises hot plating the metal article with a molten zinc, cooling the hot plated article until the surface of the article is cooled to a temperature in a range of about 350° to 400° C., coating the hot plated article with a fluidized saturated polyester resin powder to bake the resin powder on the hot plated article with the heat remaining in the plated article, and, immediately thereafter, cooling the resulting article with water; the baking of the resin powder being accomplished at a high temperature in a very short time to prevent growth of a fragile alloy between the metal article and the plated layer and also surface oxidation of the plated layer.

2. The process according to claim 1 wherein the coating with a saturated polyester resin powder is carried out by soaking the plated article in a fluidized soaking vessel containing the resin powder.

3. The process according to claim 1 wherein coating with a saturated polyester resin powder is carried out by blowing the resin powder onto the surface of the plated article.

4. The process according to claim 1 wherein the metal article is made of a metal selected from the group consisting of iron, steel, copper, and alloys thereof.

5. The process according to claim 1 wherein the plated zinc layer on the metal article is about 20 to about 100 microns in thickness and the baked layer on the plated zinc layer is about 50 to 2000 microns in thickness.

6. A continuous process for heavy-duty anticorrosion treatment of a metal article which comprises passing the metal article through a bath of a molten zinc to plate the article with zinc, cooling the hot plated article until the surface of the plated article is cooled to a temperature in a range of about 350° to 400° C., passing the plated article through a fluidized soaking vessel containing a resin consisting of a saturated polyester resin powder to bake the resin on the plated article with the heat remaining in the plate article, and, immediately thereafter, soaking the resulting article in water to rapidly cool it.

7. A process for heavy-duty anticorrosion treatment of a metal article which comprises plating the metal article with molten zinc, cooling the hot plated article until the surface of the plated article is cooled to a temperature range of about 350° to 400° C., coating the hot plated article with a fluidized saturated polyester powder to bake said powder on the hot plated article with the heat remaining in the plated article, and, immediately thereafter, cooling the resulting article in water.

8. The process according to claim 6 wherein coating with a saturated polyester powder is carried out by soaking the plated article in a fluidized soaking vessel containing the resin powder.

* * * * *